United States Patent [19]

Mai et al.

[11] Patent Number: 5,074,007

[45] Date of Patent: Dec. 24, 1991

[54] CLEANER FOR AN EXHAUST PIPE

[76] Inventors: Sung-Chuan Mai; Kung-Ming Mai, both of 87 Tso-yin Big Road, Kaohsiung City, Taiwan

[21] Appl. No.: 466,228

[22] Filed: Jan. 17, 1990

[51] Int. Cl.[5] ..... A47L 5/26

[52] U.S. Cl. ..... 15/344; 15/383; 15/395

[58] Field of Search ..... 15/344, 395, 383, 304

[56] References Cited

U.S. PATENT DOCUMENTS

| | | | |
|---|---|---|---|
| 922,225 | 5/1909 | Wegner | 15/344 |
| 1,818,282 | 8/1931 | Soss | 15/344 X |
| 2,193,999 | 3/1940 | Allen | 15/395 X |
| 2,205,599 | 6/1940 | Mitchell | 15/344 |
| 2,232,358 | 2/1941 | Baerer | 15/395 X |
| 2,251,739 | 8/1941 | Huntsinger | 15/395 X |
| 4,357,730 | 11/1982 | Lex | 15/344 |
| 4,546,519 | 10/1985 | Pembroke | 15/395 |
| 4,792,363 | 12/1988 | Franklin et al. | 15/314 X |

FOREIGN PATENT DOCUMENTS

| | | | |
|---|---|---|---|
| 1503748 | 4/1969 | Fed. Rep. of Germany | 15/344 |
| 1062393 | 3/1967 | United Kingdom | 15/314 |
| 1074900 | 7/1967 | United Kingdom | 15/304 |

*Primary Examiner*—Chris K. Moore

*Attorney, Agent, or Firm*—Bucknam and Archer

[57] ABSTRACT

A cleaner for an exhaust pipe comprises a main housing, a power means, a dirt suction means, a flexible suction pipe, a flexible wire spindle, a discharge sleeve, and a porous container. The power means and the dirt suction means are installed in the main housing. A connecting element connects the suction means chamber to a suction pipe. At the bottom of the suction means chamber are located a discharge sleeve and a porous container. A flexible wire spindle is provided at the free end with a discharge sleeve and a porous container. A flexible wire spindle is provided with a brush at the end opposite to the power means. When the flexible wire spindle and the flexible suction pipe are inserted into an exhaust pipe and the power means started, the cleaner may clean off and suck out the dirt accumulated in the exhaust pipe handily and swiftly.

8 Claims, 2 Drawing Sheets

CLEANER FOR AN EXHAUST PIPE

The present invention relates to an apparatus for cleaning the inner wall of an exhaust pipe and more precisely, the present invention relates to a cleaner of the type in which a rotating brush may be inserted into the interior of an exhaust pipe to clean the dirt effectively and a suction device sucks the dirt out the exhaust pipe quickly.

BACKGROUND OF THE INVENTION

Normally, after an engine has run for a period of time, the exhaust pipe on the engine accumulates carbon ashes, dirt substances, and water or oil on the inner surface. The dirt accumulated in the exhaust pipe may increase gradually so that the passage for the exhaust becomes narrower and the discharge rate of the exhaust becomes worse, exhaust is not discharged smoothly, unfavorable phenomena occur, such as the temperature of the engine cylinder rises above the acceptable range, part of the exhaust remains in the engine cylinder, etc. The rise of the temperature in the engine cylinder may unfavorably affect the fuel burning process during the combustion stroke. When exhaust remains in the engine cylinder, insufficient fuel-air mixture results or insufficient pure air capable of entering the engine cylinder is available during the intake stroke. Even more serious, these phenomena will lead to undesirable drawbacks such as low engine running efficiency, deficient horsepower, and harmful exhausts are formed toxic to health. Therefore, it is quite important to keep the inner wall of an exhaust pipe clean and also to clean exhaust pipes for engine maintenance.

Nevertheless, up to the present, there has not been a proper and handy cleaning tool available for cleaning the inner wall of an exhaust pipe so that keeping the exhaust pipe clean is a problem for the maintenance personnel. Frequently it is necessry to replace the exhaust pipe instead of cleaning the exhaust pipe.

SUMMARY OF THE INVENTION

The crux of the cleaner for an exhaust pipe according to this invention resides in the fact that the cleaner is provided with a power means which drives a suction means and rotates a brush, the latter being inserted into the exhaust pipe to perform a cleaning Job, and the dirt which is removed from the inner wall is then sucked into a porous container through a suction pipe.

An object of the present invention is to provide a cleaner according to which the dirt stuck on the inner wall of an exhaust pipe ma be cleaned out easily and efficiently to maintain a smooth passage for the exhaust, to avoid low engine running efficiency, and to reduce the presence of harmful components mixed in the exhaust.

Another object of the invention is to provide an easily operated cleaner for an exhaust pipe to lower the maintenance expense and to prolong service life of the exhaust pipe.

Still another object of the invention is to provide a special cleaner for an exhaust pipe in which a brush may reach the parts to be cleaned in an exhaust pipe to guarantee the cleaning Job.

Another object of the invention is to provide a contamination proof cleaner for an exhaust pipe in which a porous container may collect all the dirt to avoid air pollution.

BRIEF DESCRIPTION OF THE DRAWING

The present invention will be further illustrated, by way of example, with reference to the accompanying drawings, in which.

DETAILED DESCRIPTION OF THE PREFERRED EMBODIMENT

Figure 1:
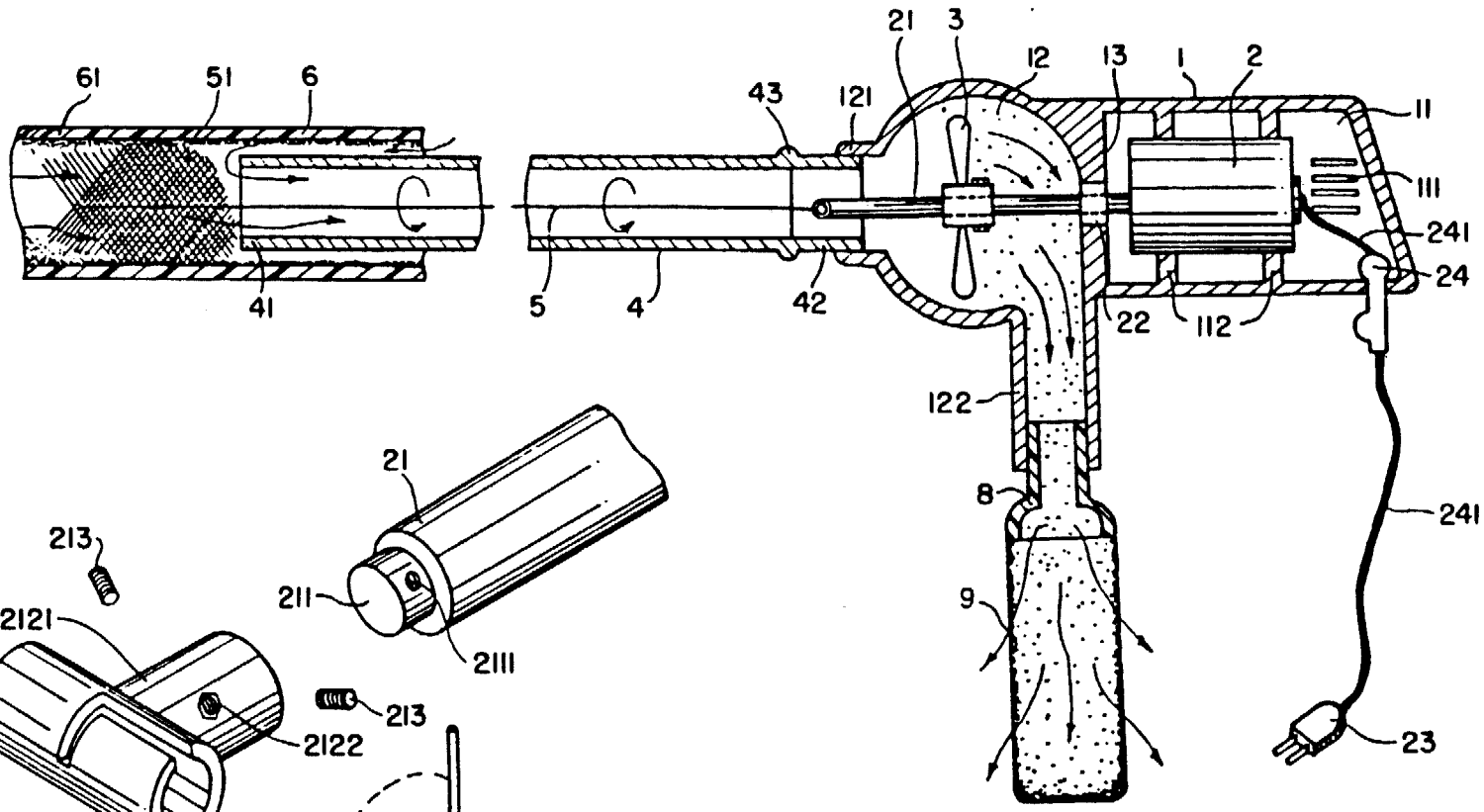
FIG. 1 is a cross-sectional view of an embodiment of the invention with a fragmentary sectional view of an exhaust pipe, showing components of the cleaner and the brush on the cleaner inserted into said exhaust pipe.

By reference to FIG. 1; the cleaner for an exhaust pipe basically comprises a main housing 1, a power means 2, dirt suction means 3, a flexible suction pipe 4, a flexible wire spindle 5, a discharge sleeve 8, and a porous container 9. The main housing 1 is divided into two parts, one is the power means chamber 11 and the other is a suction means chamber 12. The power means chamber 11 is adapted to receive the power means 2 and the power means 2 may be an electric motor or equivalent means. The electric wire 241 and the power on-off switch 24 provided to connect the power means 2 are also located in the power means chamber 11. There are a plurality of heat dissipating openings 111 at the two lateral side walls of the power means chamber 11 to allow the heat generated by the power means 2 to escape to the outside. A plurality of rib supports 112 are provided around the power means chamber 11. A plug 23 is provided at the end of the electric wire 241 to connect with a power source.

The suction means chamber 12 has smooth arc corners instead of sharp corners to prevent the dirt sucked in to remain off the walls of the suction means chamber 12. A connecting element 121 connects the suction chamber with the flexible suction pipe 4. A partition 13 is located between the suction means chamber 12 and the power means chamber 11 to separate the two chambers. A discharge pipe section 122 is provided at the bottom of the suction means chamber 12 and underneath the partition 13 to discharge the dirt sucked. The shaft 21 of the power means 2 horizontally extends through a bearing 22 attached to said partition 13 to reach to a point near the connecting section 121.

The dirt suction means 3 is positioned near the central space in the suction means chamber 12 and is secured to the shaft 21. The suction means 3 may be an axial flow type suction fan as shown in FIG. 1 or a centrifugal type suction fan. The shaft 21 is fitted with the flexible wire spindle 5 at the end near the connection section 121. The flexible wire spindle 5 has an appropriate length and a brush 51 is provided at the free end of the flexible wire spindle 5. The brush 51 is composed of a plurality of short shaped metal or plastic pieces arranged crosswise fixed to the flexible wire spindle 5 at the free end. The material of the brush 51 may be a liquid absorbing cloth to clean the dirt which contains moisture or oil. The flexible suction pipe suction pipe 4 is provided with a joint section 42 at one end, and the outer diameter of the Joint section 42 is the same as the inner diameter of the connecting section 121 so as to be detachably fitted with each other.

A ring knob 43 is located near the Joint section 42 for disassembling easily the flexible suction pipe 4 from the connecting section 121. The flexible suction pipe 4 has a length smaller than that of the flexible wire spindle 5 so that the brush 51 may extend outside the flexible suction pipe 4 when the flexible suction pipe 4 has been assembled with the connecting section 121 on the main housing 1. The free end of said flexible suction pipe 4 is stiff so that the opening of the free end will not be deformed to weaken the suction effect while the suction operation is in process. The flexible suction pipe 4 and the flexible wire spindle 5 are capable of extending along an exhaust pipe and reaching any spot within the exhaust pipe even if the exhaust pipe is formed to bend in different directions. The discharge sleeve 8 is detachably fitted with the discharge pipe section 122 on the main housing 1. The lower end of the discharge sleeve 8 is diverging to allow the moving dirt to go down. The porous container 9 is attached to the discharge sleeve 8 and encloses the diverging end of the discharge sleeve 8.

Figure 2:
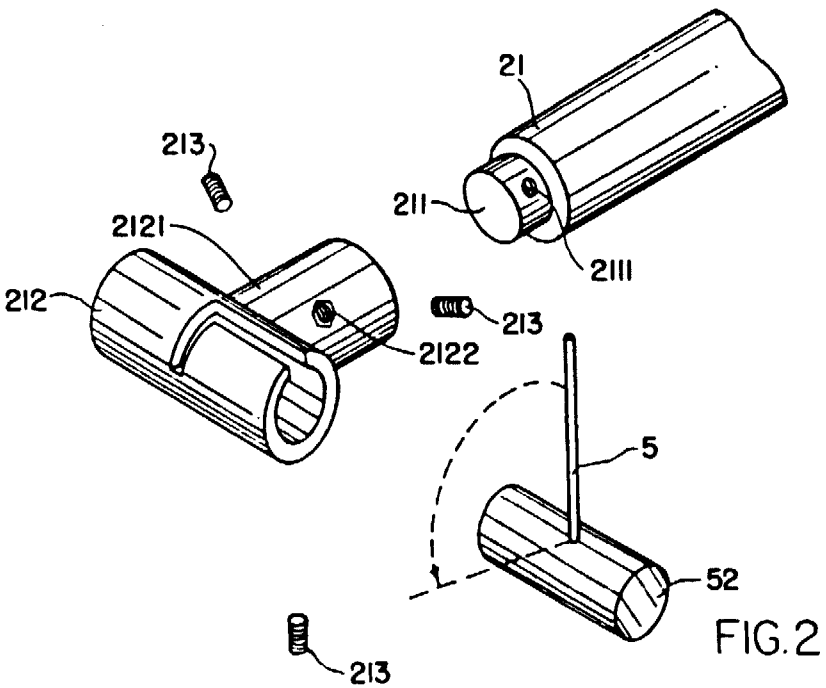
FIG. 2 is an exploded and fragmentary view in perspective of a shaft and a flexible wire spindle provided on the cleaner of FIG. 1 showing how both of them are connected with each other.

With reference to FIG. 2, this is an enlarged exploded view in perspective showing how shaft 21 connects with the flexible wire spindle 5. A neck section 211 is provided at the end of the shaft 21 to connect with the sleeve part 212 at the end of the flexible wire spindle 5. The diameter of the neck section 211 is smaller than that of the other part of the shaft 21. Several radial tiny screw holes 2111 are properly located on the circumferential surface with equi-angular distance on the neck section 211. The sleeve part 212 is a horizontal cylinder with a connecting part 2121. The connecting part 2121 is located in the middle of the sleeve part 212 and is fixed to the lateral surface of said sleeve part 212 so that the axis of the sleeve part 212 becomes perpendicular to and intersects the axis of the connecting part 2121. The sleeve part 212 is provided with a "L" shape slot which extends along the top and is parallel to the axis of the sleeve part 212 from one end to the middle and then turns to the front lateral side directly to extend a quarter of the circular distance along the circumferential direction. The connecting part 2121 basically is a short hollow cylinder. An end of the said connecting part 2121 is fixed to the sleeve part 212 and the other end is intended to engage with neck section 211. The outer diameter of the connecting part 2121 is equal to the diameter of the shaft 21 and the inner diameter of the connecting part 2121 is equal to the diameter of the neck section 211 for detachably engaging with the neck section 211.

The connecting part 2121 is also provided with several radial screw holes 2122 with equal angular distance on the circumferential surface to correspond to the radial screw holes 2111 on the neck section 211 and to engage with the neck section 211 by using set screws 213.

The flexible wire spindle 5 has a Joint head 52 at one end which is of cylinderical shape and the point at which the joint head 52 is secured to the flexible wire spindle 5 is located in the middle of the circumferential surface of the Joint head 52 so that the axis of the joint head 52 is perpendicular to and intersects the axis of the flexible wire spindle 5. The diameter of the joint head 52 is equal to the inner diameter of the sleeve part 212 so that they fit one with the other.

Figure 3:
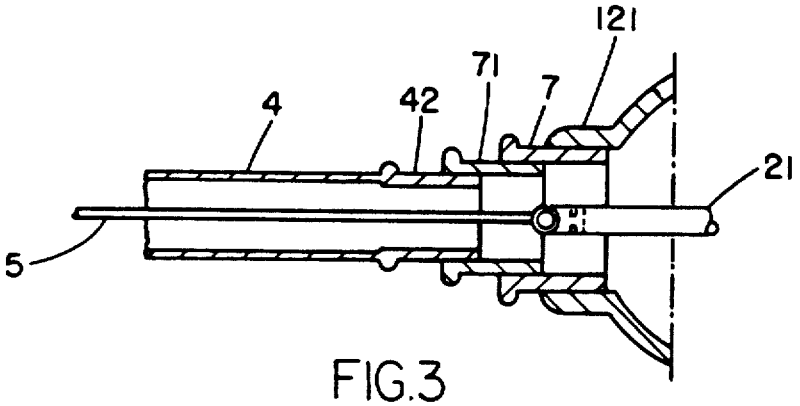
FIG. 3 is fragmentary cross-sectional view of a connecting section of the main housing and the flexible suction pipe shown in FIG. 1 being connected on to the other by means of adapters.

While assembling the joint head 52 and the sleeve part 212, the flexible wire spindle 5 is held upright and the joint head 52 is inserted into sleeve part 212 to allow the flexible wire spindle 5 to move along the long slot till the joint head 52 fits with the sleeve part 212 and then the flexible wire spindle 5 is turned to the horizontal in the middle of the sleeve part FIG. 3 illustrates another embodiment of the connecting element 121 on the main housing 1 with the flexible suction pipe 4 shown in FIG. 1. Two adapters 7 and 71 are inserted between the element 121 and the Joint section 42.

The diameter of the flexible suction pipe 4 may be of different sizes to be capable of cleaning exhaust pipes of different diameter. In order to fit with a smaller size flexible suction pipe 4, the connecting element 121 has to be fitted with a plurality of adapters of successively different diameter. Each adapter is a short circular pipe with a ring knob at a proper location on the outer surface to ease the fitting operation. The two adapters 7 and 71 shown in FIG. 3 are shown only by way of example but if necessary, more adapters may be used.

In a practical application, when the exhaust pipe in a car has to be cleaned, first of all, the diameter size of the exhaust pipe has to be determined. Commonly, there are three sizes available, 2 inches, 1 ½ inches and 1 inch. The flexible suction pipe 4 can be provided of three diameter sizes that is, large size, medium size, and small size for cleaning three sizes of exhaust pipes, respectively. If the connecting element 121 is designed to be fitted with a large size flexible suction pipe 4, the cleaning Job in a 2 inch exhaust pipe may be performed directly without any adapter. If a 1 inch exhaust pipe has to be cleaned, a small size flexible suction pipe may be connected with the connecting element 121 by adding two adapters. The advantage of using adapters of different sizes of the flexible suction pipe is to allow a cleaner to clean exhaust pipes of different size to increase its effectiveness.

Figure 4:
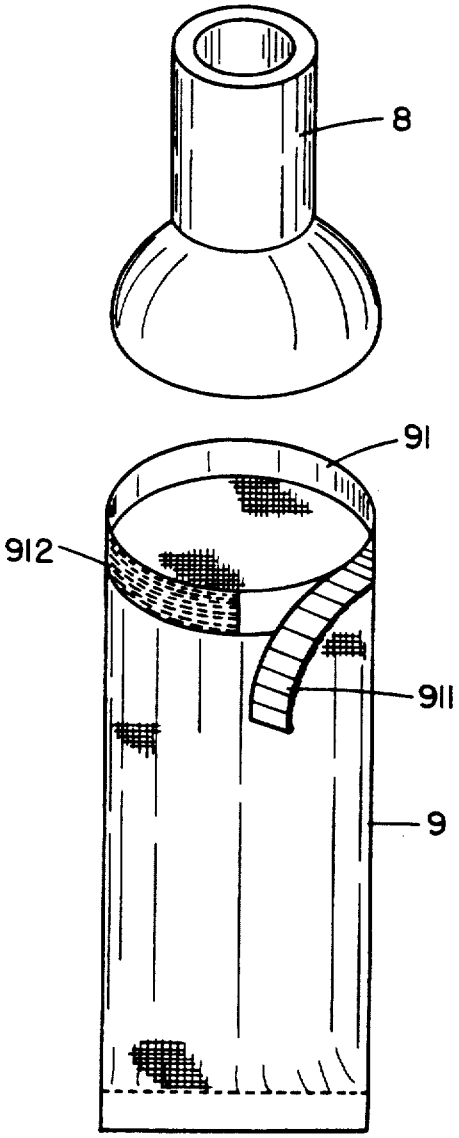
FIG. 4 is an exploded view in perspective of a porous container and a discharge sleeve provided on the cleaner of FIG. 1 showing the elements snapped to each other on top of the porous container.

FIG. 4 illustrates an example of the manner how a porous container 9 is secured to the discharge sleeve 8. If the dirt were discharged directly to the open air through the discharge pipe section 122 on the main housing 1 shown in FIG. 1, air pollution would result. In order to avoid pollution, the porous container 9 plays an important role. The porous container 9 may be made of porous material like cloth or paper. A snap band 91 shown in FIG. 4 may be applied to secure the porous container 9 to the discharge sleeve 8. The snap bond 91 is provided at the top of the porous container 9. An end part of the snap end 91 is separated from the porous container 9 and some glueing material is placed on the upper surface of the end part to constitute a snapping section 911. The other end of the snap bond 91 has its lower surface fixed to the porous container 9 and the upper surface is also provided with snapping or glueing material to constitute another snapping section 912. After enclosing the diverging end of the discharge sleeve 8 in the porous container 9, the top end of the porous container 9 is tied to the discharge sleeve 8 with the snap band 91 and then the snapping section 911 is secured to the snapping section 912 to connect the porous container 9 with the discharge sleeve 8. While cleaning is carried out, the porous container functions like a filter to collect all the dirt sucked out and allows clean air to flow through. When the cleaning job is finished, the porous container 9 is taken off and is disposed properly to prevent contamination.

The operation procedure of the cleaner for an exhaust pipe is explained hereinbelow. The plug 23 is connected with a power source, the flexible wire spindle 5 is connected with shaft 21, a flexible suction pipe 4 of the proper size is connected with the connecting section 121 on the main housing 1. The porous container 9 is fixed to the discharge sleeve 8. Then the flexible wire spindle 5 is inserted and the flexible suction pipe is inserted into the exhaust pipe to be cleaned. Then the discharge pipe section 122 is held with a hand, the rear end of the main housing 1 is held with the other hand and the on-off switch 24 is pushed down. In this way, the dirt suction operation is carried out swiftly and efficiently. The advantages are convenient operation, excellent cleaning effect, and short operation time.

We claim:

1. A cleaner for removing dirt from an exhaust pipe comprising a housing, a vertical partition (13) in said housing dividing said housing into a power means chamber (11) and a suction means chamber (12), a shaft (21) extending horizontally through said power means chamber, power means located in said power means chamber, said suction means chamber having rounded corners, suction means located in said suction means chamber, a flexible suction pipe (4), a connecting element (121) connecting said suction means chamber to said suction pipe, said shaft (21) extending to said connecting element (121), said suction means being attached to said shaft (21), a discharge pipe at the bottom of said suction means chamber and extending downwardly from said partition, a discharge sleeve (8) detachably coupled with said discharge pipe, a flexible wire spindle (5) coupled to said shaft at the end far from said power means, a rotating brush (51) at the end of said wire spindle, a porous container (9) to collect dirt secured to the end of said discharge sleeve, said power means driving said suction means and said rotating brush, said flexible wire spindle being located in said flexible suction pipe and being longer than said flexible suction pipe whereby said brush protrudes outside of said flexible suction pipe.

2. The cleaner according to claim 1 wherein said flexible suction pipe has a stiff end to fit with said connecting element and the opposite end is also stiff to prevent deformation during operation.

3. The cleaner according to claim 1 wherein said brush at the free end of said flexible wire spindle is made of a plurality of short segments of metal, plastics, or cloth arranged crosswise and fixed to said flexible wire spindle.

4. The cleaner according to claim 1 wherein said exhaust pipe has a diameter and said flexible suction pipe is of a variable size, corresponding to the diameter of the exhaust pipe.

5. The cleaner according to claim 4 which comprises adapters of different diameter to couple said flexible suction pipe to said connecting element.

6. The cleaner according to claim 1, wherein said discharge sleeve has a diverging lower end to flow down the speed of the moving dirt flowing into said porous container.

7. The cleaner according to claim 1 wherein said suction means chamber has rounded corners.

8. The cleaner according to claim 1 which is manually operated.

* * * * *